US007293302B2

(12) United States Patent
Mesa

(10) Patent No.: US 7,293,302 B2
(45) Date of Patent: Nov. 13, 2007

(54) SHOWERHEAD HOLDER

(76) Inventor: Allan A. Mesa, 1330 NE. 200th Ter., North Miami Beach, FL (US) 33179

( * ) Notice: Subject to any disclaimer, the term of this patent is extended or adjusted under 35 U.S.C. 154(b) by 0 days.

(21) Appl. No.: 11/421,796

(22) Filed: Jun. 2, 2006

(65) Prior Publication Data

US 2006/0272086 A1 Dec. 7, 2006

Related U.S. Application Data

(60) Provisional application No. 60/687,921, filed on Jun. 6, 2005.

(51) Int. Cl.
*A47K 3/022* (2006.01)

(52) U.S. Cl. ..... 4/601

(58) Field of Classification Search ..... 4/567, 4/568, 570, 601, 605, 615, 604; 239/282, 239/283, 587.3, 587.4; 248/288.31
See application file for complete search history.

(56) References Cited

U.S. PATENT DOCUMENTS 4,998,836 A * 3/1991 Scripnick ..... 401/42
6,446,278 B1 * 9/2002 Lin ..... 4/615
6,497,814 B1 * 12/2002 Alexander et al. ..... 210/108
6,973,682 B2 * 12/2005 Zhadanov ..... 4/601

* cited by examiner

*Primary Examiner*—Huyen Le
(74) *Attorney, Agent, or Firm*—Robert M. Schwartz; David W. Barman

(57) ABSTRACT

A showerhead holder is provided for use with an original equipment manufacturer's showerhead connector and cradle to hold the handle of the removable showerhead in a desired position selected by the user.

18 Claims, 3 Drawing Sheets

FIG. 1
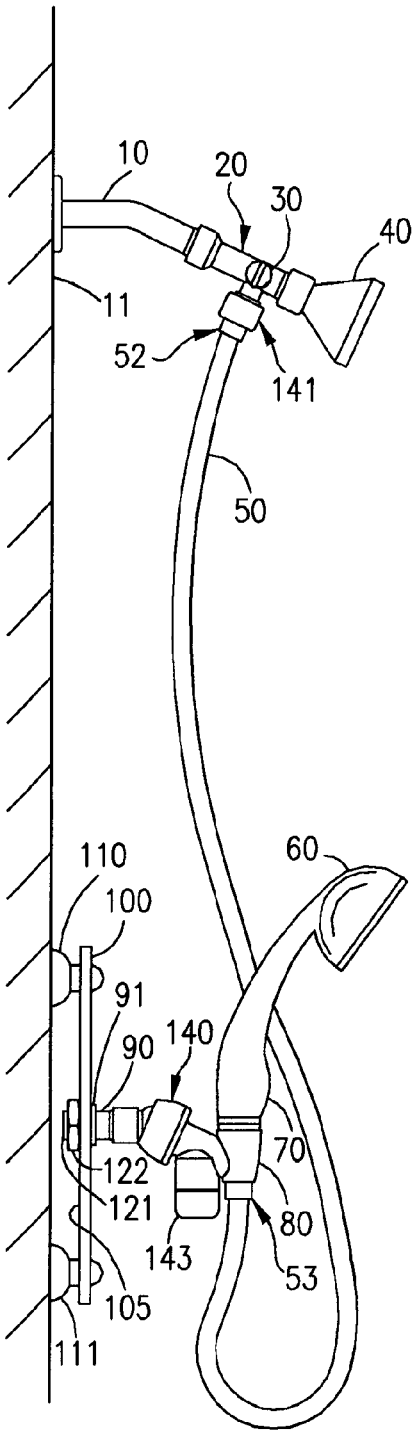
FIG. 2
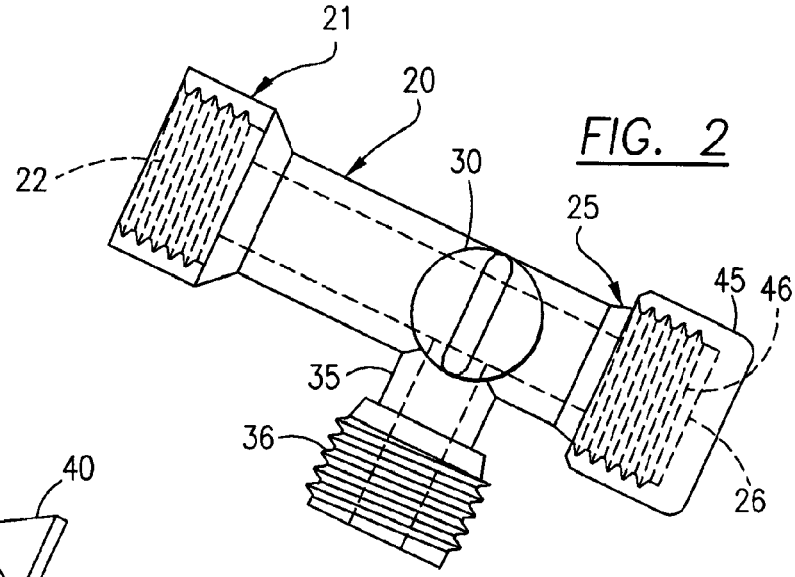
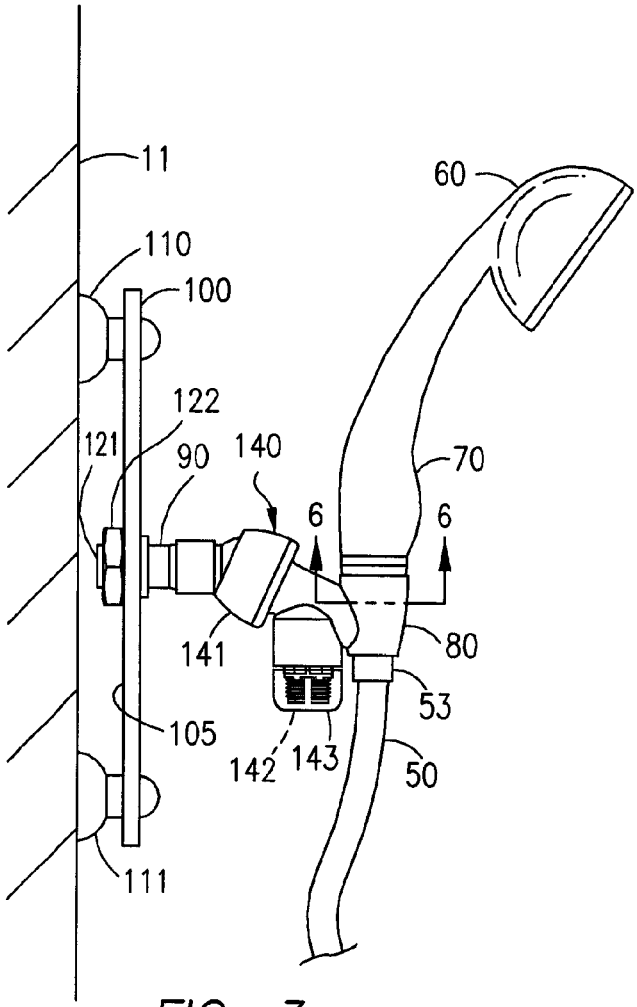
FIG. 3

SHOWERHEAD HOLDER

INDEX TO RELATED APPLICATIONS

This application claims benefit of U.S. provisional patent application Ser. No. 60/687,921 filed Jun. 6, 2005.

BACKGROUND OF THE INVENTION

The present invention relates to a showerhead holder for use preferably with a commercially available removable showerhead unit, such as model Nature Mist, from LDR Industries, Inc., Chicago, Ill.

A showerhead is a common fixture for directing the spray of water usually within a shower enclosure having one or more walls to form an enclosure. The enclosure usually has at least one entrance e.g. door. One of the more popular add on showerheads are those that are attached using a hose to a holder at the location of the original showerhead that may be removed at the desire of the user. There are several well-known hand-held showerheads that are commercially available. The heads typically come in a kit comprising a connector, a hose, and the showerhead connected to a handle. Oftentimes, a user will desire, when removing the removable showerhead, to affix it to a different location on a wall within a shower enclosure. In this manner, for example, the spray is directed to a body part or portion of the user's body, while having both of the user's hands free.

In addition, the showerhead handle often rests in a cradle that is part of the connector at a height of greater than 5-6 feet, often the height is greater than 6 feet. This is because although there is no specific rule, most plumbers install the outlet pipe in a shower 75-78 inches above the floor as a matter of course. This height presents difficulty for children, the elderly, and those that are either not tall enough to reach the handle, or have difficulty unseating the handle from it's cradle. Often, people who have difficulties with the height of the cradle will allow the handle to hang loose. This is often not desirable for many reasons. One reason is if there is any tendency for the showerhead to leak, the hanging position will increase any leaks. Additionally, many will not consider a showerhead handle hanging off the wall to be aesthetically pleasing. One possible solution is to have a cradle that may hold the showerhead handle in a lower position. The problem with an after market cradle is that showerhead handles are not standardized and it would be difficult to provide different cradle sizes and shapes for all of the different brands and sizes. The present invention has addressed this difficulty. The present invention provides for the securing of the removable showerhead utilizing the connector and cradle provided by the original equipment manufacturer (OEM).

The present invention relates to a showerhead holder, a system, and a kit that is used to hold a removable showerhead at different locations in a shower or bathtub.

Removable showerheads have an attachment fitting that connects to a supply pipe with a threaded male end, that issues from the wall of the shower. The fitting has a female threaded connection that is screwed onto the supply pipe. The fitting includes a supply line that tees off of the fitting. The supply line connects to a hose that supplies water to the showerhead. Typically the removable showerhead has an elongated handle, which is used for a person to hold in ones hand. The attachment fitting has an adjustable C-shaped retainer or cradle that holds the showerhead by the handle when a person does not want to hold the showerhead (during lathering, shampooing, etc.).

The disadvantages of the showerhead retainer as described above are that the shower stream can only be directed to the parts of the body where the supply pipe issues from the wall, i.e. if the supply pipe is overhead, the stream is only directed to the upper parts of the body such as the head, neck and shoulders. Furthermore, when disposed opposite the shower entrance, the water stream can deflect out of the shower while waiting for the temperature of the water to reach the desired temperature.

BRIEF SUMMARY OF THE INVENTION

The present invention is a showerhead holder that is easy to use and overcomes the disadvantages described above.

The present invention is a showerhead holder for use with a detachable hand-held showerhead comprising:

(a) a mounting plate;

(b) a male connecting means;

wherein said male connecting means is attached to said mounting plate and is able to receive the original equipment mounting coupling manufactured and supplied with said detachable showerhead.

The showerhead holder can be used for therapeutic massage in the shower to allow the removable showerhead e.g. pulsating shower massage to be directed to any body part, eg. sore muscles. This can be done hands free such that the showerhead holder allows the removable showerhead to be aimed at any body part, from a position adjacent to the body part, from the showerhead when held at a wall location, using the showerhead holder of the present invention.

The showerhead holder mounting plate further comprises means for mounting said plate to the wall of a shower. In one preferred embodiment, the mounting plate is attached to the wall of a shower by suction cups.

Further, in one embodiment, the showerhead holder male connecting means may be a male threaded attaching means. Although, it is contemplated that any acceptable attaching means may be used as the male connecting means. One such connecting means may be a fluid quick connect/disconnect, a female means or the like.

In another preferred embodiment, the showerhead holder provides for the male connecting means to hold the OEM connector and allow the showerhead handle to rotate 360° while attached to said mounting plate. Also contemplated as part of the invention is a system for a shower comprising:

(a) a first showerhead which is a detachable hand held showerhead;

(b) a connecting means for a second showerhead which is in a fixed position;

(c) a directional fluid valve;

In the system, the user may select a fixed showerhead or the removable showerhead by changing the direction of the water supplied by moving the directional fluid valve.

In another preferred embodiment, the system further has a detachable hand-held showerhead that is mounted on a showerhead holder for use with a detachable hand-held showerhead comprising:

a. a mounting plate;

b. a male connecting means;

The male connecting means is attached to said mounting plate and is able to receive the original equipment manufacturer's coupling, which was manufactured and supplied with the kit containing the detachable showerhead.

The mounting plate further comprises means for mounting said plate to the wall of a shower.

In one preferred embodiment, the mounting plate is attached to the wall of a shower by suction cups. The male connecting means may be a male threaded attaching means.

In another preferred embodiment, the male connecting means can allow the OEM connector to rotate 360° while attached to said mounting and while said mounting plate is attached to a wall.

Further contemplated as part of the invention is a kit for converting a single head fixed position showerhead into a configuration for dual head shower operation, wherein the user may select use of a fixed position showerhead or a hand held detachable showerhead. The kit comprises:

(a) a it-type connector wherein said connector attaches to the existing attached plumbing fixture;

(b) a showerhead holder for use with a detachable hand-held showerhead comprising:

i. a mounting plate;

ii. a male connecting means;

In one embodiment, the male connecting means is attached to a mounting plate and is able to receive the original equipment manufacturer's mounting coupling manufactured and supplied with said detachable showerhead.

In a preferred embodiment, the kit has a t-type connector that has one end that may receive a fixed position showerhead and one end to receive a hose for a detachable hand-held showerhead.

Another embodiment provides that the kit further comprises a cap for affixing to one opening of the t-type connector to configure the system for a single detachable hand-held showerhead.

In an embodiment where there is a fixed position showerhead and a hose leading to a hand held showerhead, the t-type connector further comprises a directional fluid valve.

The present invention improves the positionability of a moveable showerhead by allowing the showerhead to be positioned on a holder that can be placed at different locations in the shower.

It is an object of the present invention to provide a system and kit for securing the handle of a removable showerhead.

It is another object of the present invention to provide a mounting plate, wherein the plate will accept the OEM connector for a removable showerhead.

It is another object of the present invention to provide a configuration whereby the user may select a water source from a fixed showerhead or a removable showerhead.

As used and understood herein, the term removable showerhead refers to a showerhead that is operational when being moved (i.e. not mounted in a fixed immovable position).

BRIEF DESCRIPTION OF THE DRAWINGS

The embodiments of the invention are illustrated by way of example, and not by way of limitation, in the figures of the accompanying drawings in which like reference numerals refer to similar elements. In the drawings:

FIG. 1 is a side view of the present invention wherein the t-type connector is attached to the supply pipe that issues from the wall of shower and has a hose running to a movable showerhead handle which is cradled on a connector attached to a mounting plate that is attached to the wall of the shower.

FIG. 2 is a side view of a t-type connector used in the system and kit of the present invention where the position for the fixed showerhead is plugged with a cap by means of female threads that interact with the threaded male portion of the t-type connector.

DETAILED DESCRIPTION OF THE PREFERRED EMBODIMENTS

Figure 3:
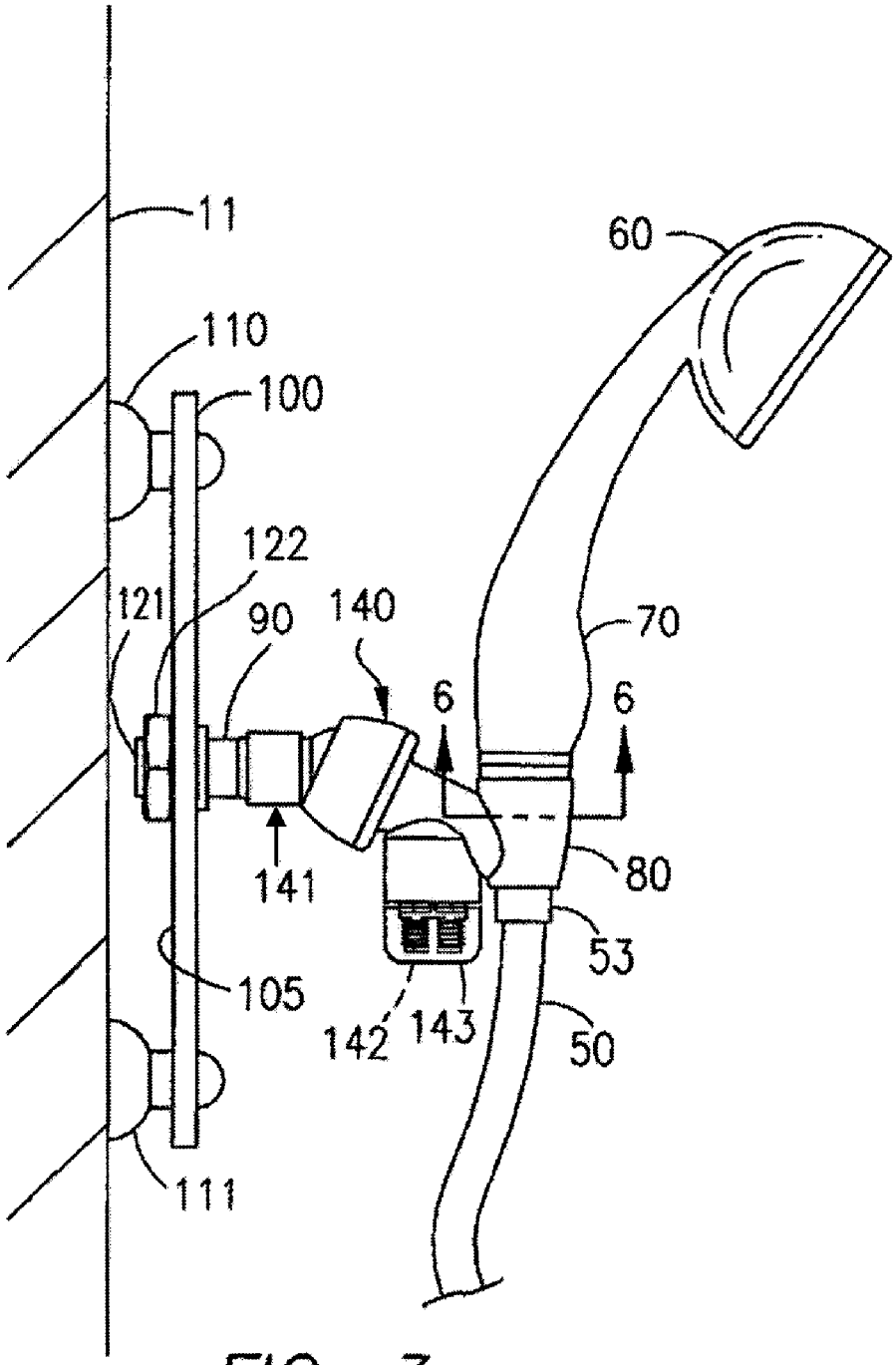
FIG. 3 is an expanded view of the mounting plate wherein the connector is attached to the mounting plate by means of a threaded male connector.

In the following description, numerous specific details are set forth. However, it is understood that embodiments of the invention may be practiced without these specific details. In other instances, well-known structures and techniques have not been shown in detail in order not to obscure the understanding of this description. In the illustrated embodiments, the OEM kit shown for a removable shower head comprises;

a showerhead on a handle;

a connector, wherein said connector comprises an inlet, which is a female threaded connector to be attached to the supply pipe, an outlet, which is a threaded female connector for attaching a hose, and a cradle, for holding the handle comprising the showerhead; and a hose, which provides water supply from the supply pipe through the connector, through the hose, and to the showerhead attached to the handle.

As shown, FIG. 1 is an embodiment of the present invention. Supply pipe 10 issues from a wall of a shower enclosure. A shower enclosure typically has at least one wall. Any type of enclosure is contemplated for use with the present invention. In a preferred embodiment, a shower enclosure has 3 walls and some type of entrance. T-type connector 20 attaches to supply pipe 10 by male-female combination. In a preferred embodiment, supply pipe 10 has a terminal end 12 with a male threaded connecting means 13. T-type connector 20 has a proximal end (proximal to the shower wall) 21 with a threaded female connecting means 22 that interacts with the male threaded connecting means 13 on terminal end 12 of supply pipe 10 to effectuate the connection sufficient such that a watertight seal is formed. The integrity of the seal may further be enhanced through the use of Teflon tape or other means known in the art. T-type connector 20 further has a handle 30 controlling an internal directional fluid control valve as is commonly known. A user may select water flow to continue through fixed showerhead 40 or through exit portal 35 attached to hose 50, directing the water flow to and through removable showerhead 60. Hose 50 includes proximal end 52 and distal end 53.

Hose 50 connects to showerhead handle 70 which supports movable showerhead 60. Handle 70 is placed in a cradle 80 that is part of the OEM kit supplied with the removable showerhead product. The cradle 80 is part of the connector 140 that is intended to connect with the shower supply pipe. In the present invention, the OEM connector 140 is attached to a mounting screw 90 that is attached to mounting plate 100.

Figure 5:
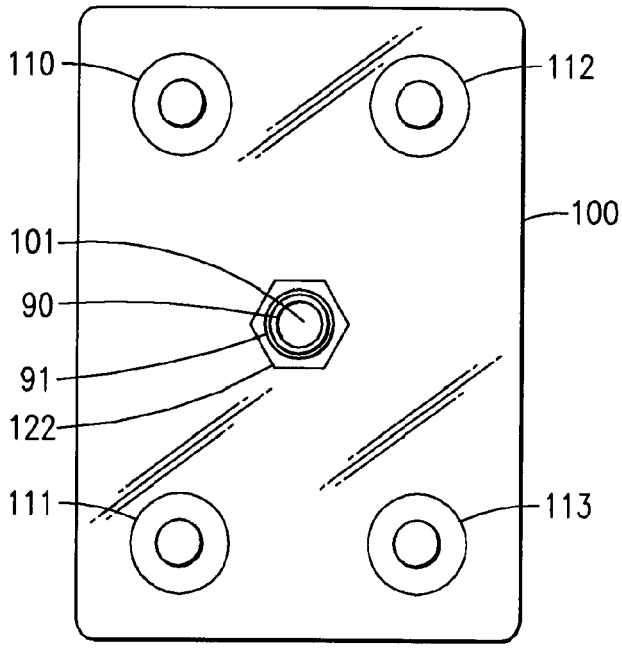
FIG. 5 is a front view of the mounting plate of the present invention.
Figure 6:
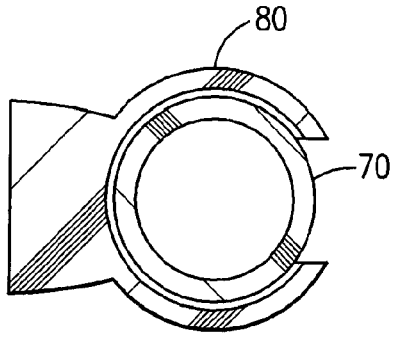
FIG. 6 is a sectional view of the OEM showerhead handle and cradle along lines 6-6 in FIG. 3.

Mounting plate 100, as shown in FIG. 2, and FIG. 5 is attached to shower wall 11 with suction cups 110, 111, 112 and 113. Mounting plate 100 has a cavity 101 through which mounting screw 90 may pass. The end of mounting screw 90 proximal to the shower wall has a male threaded end 121 and is secured into place by nut 122 with female threaded attaching means. Mounting screw 90, includes a shoulder 91, that abuts plate 100. The distal end of mounting screw 90 also has a male threaded connecting means 131. The OEM connector 140 that is typically provided with a removable showerhead assembly has a standardized female threaded connector 141. The female threaded connector 141 is intended to be mounted on the supply pipe 10. Because this is a standardized size, the distal end of mounting screw 90 of the present invention has a male threaded connecting means 121 that is congruous with the male threaded connecting means 13 found on terminal end 12 of supply pipe 10. In this configuration, the distal end of mounting screw 90 of the present invention has a male threaded connecting means 121 that will accept most, if not all OEM connectors that are supplied with removable showerhead kits.

The present invention does not need to rely on matching a nesting cradle with showerhead handles of varying sizes and shapes. The present invention allows for a system by which the OEM connector 140, which comprises an appropriately sized cradle 80 for handle 70 in which it is paired and sold, is used as the cradle 80 in the present invention to support showerhead 60 in its new location.

T-type connector 20 seen in FIG. 3, has handle 30 for controlling an internal directional fluid control valve and distal end 25 with threaded male connecting means 26 which, in this embodiment is sealed closed with a cap 45 comprising female threaded connector 46.

Figure 4:
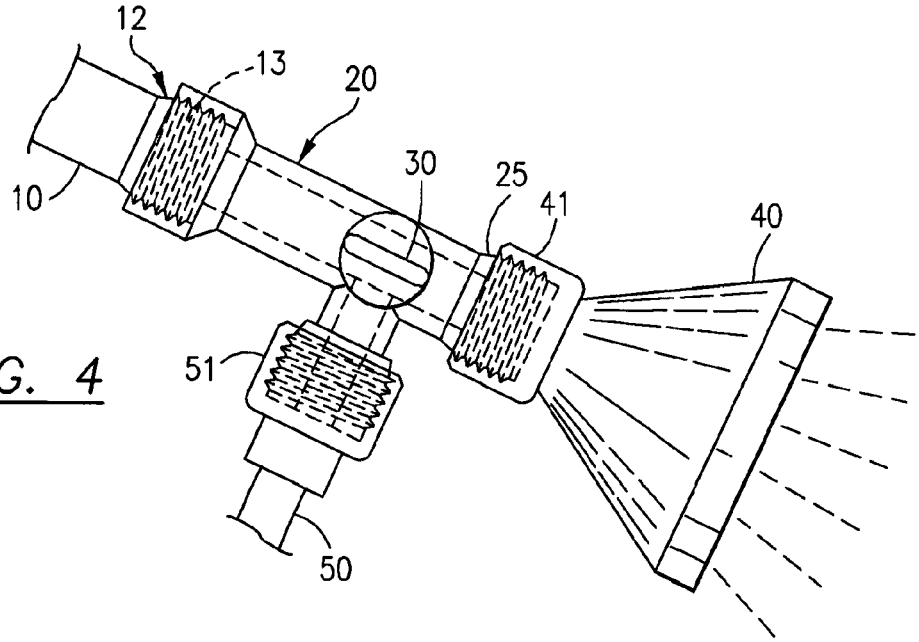
FIG. 4 is a side view of a t-type connector used in the system and kit of the present invention where the position for the fixed showerhead has a fixed showerhead attached by means of female threads that interact with the threaded male portion of the t-type connector.

One embodiment of the present invention is shown in FIG. 4, wherein t-type connector 20 has handle 30 for controlling an internal directional fluid control valve and distal end 25 with threaded male connecting means 26 which, in this embodiment has a fixed showerhead 40 connected to t-type connector 20 by female threaded connector 41 interacting on distal end 25 with threaded male connecting means 26.

The present invention relates to the system and kit. The system comprises utilization of a t-type connector. The t-type connector may be easily supplied as a standardized part because the supply pipe used in showers is typically standardized. A vast majority of supply pipes are 0.5 inch internal diameter. Even if other sizes are present, they are typically standard sizes with standard male screw threading and would not pose a difficulty in practicing the invention.

The user will attach t-type connector 20 supplied with the system and kit of the present invention to shower wall 11. The user will attach the proximal end 21 to the shower supply pipe 10. Although it is connected by conventional male-female threaded screw means, it is common practice when working with plumbing fixtures to apply Teflon tape to the threaded male screw threads in order to assist in creating a water tight seal. Alternatively, all connections may be made by quick connect/disconnect, or any other appropriate means.

The exit port 35 along the length of the body 20 of the t-type connector has a threaded male connecting means 36 similar to the one found on the supply pipe 10. This threaded male connecting means 36 will accept the threaded female connecting means 51 of hose 50 that is supplied with removable showerheads.

The user may configure this system in one of several ways. The user may install a threaded cap 45 over the distal end 25 of the t-type connector 20 as seen in FIG. 2. Optionally, the user may install a fixed showerhead 40 on the distal end 25 of the t-type connector 20 as seen in FIG. 4. When the user has installed a fixed showerhead 40 on the distal end of the t-type connector, the user may then use handle 30 for controlling an internal directional fluid control valve to select the water flow for the fixed showerhead 40 or to hose 50 to the removable showerhead 60. Water is supplied to removable showerhead 60 by moving the valve and directing water into hose 50 that has been attached to the t-type connector.

Mounting plate 100 of the present invention has one side 105 with suction cups 110, 111, 112 and 113 for attaching to shower wall 11. Mounting plate 100 has a cavity 101 through which a mounting screw 90 is placed. Mounting screw 90 is secured to the mounting plate 100 on the suction cup side 105 by a threaded nut 122 or a bolt. Mounting screw 90 has a male threaded screw end 121 of congruous size and shape as the male screw end 13 of the supply pipe 10. The mounting screw 90 is able to accept the connector 140 supplied with the removable showerhead 60 and handle 70. The connector 140 supplied with the removable showerhead 140 comprises a ball and socket-type arrangement 141, whereby the connector assembly 140 may be rotated 360° as desired. Connector 140, typically includes a male port 142 for attaching the hose 52 in the original OEM configuration. Cap 143 is used in the present arrangement, since this male port 142 is not needed.

Further, by utilizing the OEM connector assembly 140, the cradle 80 of the connector assembly 140 is configured for the particular size and shape of removable showerhead handle 70 with which it was supplied. Showerhead handles 70 from OEM suppliers come in many assorted sizes and shapes. In this manner of the present invention, the cradle 80 now supported on mounting plate 100, will always match handle 70, since both come from the OEM.

It is further contemplated that the invention comprises a kit with which the user configures their shower as desired. The kit will contain:

(a) a t-type connector with a directional fluid control valve;

(b) a mounting plate, with suction cups to secure the mounting plate to the shower wall, wherein the mounting plate has at least one cavity for receiving a mounting screw;

(c) a mounting screw, with a bolt or threaded cap for securing the mounting screw to the mounting plate;

(d) a cap for closing one exit port of the t-type connector if the user does not desire to have both a fixed showerhead and a removable showerhead.

The kit will comprise figures and directions as to the installation and operation of the system.

Although the illustrated examples and embodiments relate to connections by means of complimentary male-female screw-type connections, any suitable connection for affecting a watertight connection may be used. This may include, but would not be limited to, fluid quick connect/disconnects and the like.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A showerhead holder for use with a detachable hand-held showerhead, the hand-held showerhead having a handle, the hand-held showerhead supplied with a mounting coupling having a nesting cradle configured for the size and shape of the handle for releasably holding the hand-held showerhead, and the mounting coupling having a standard female connector for connection to a standard male shower supply pipe, the holder comprising:

(a) a relocatable mounting plate;

(b) said mounting plate having a male connector disposed thereon and extending outward from a planar surface of said plate, said male connector having a mounting end;

(c) said mounting end of said male connector releasably configured for receiving the female connector thereby supporting the hand-held showerhead.

2. The showerhead holder of claim 1 wherein said mounting plate is releasably attached to a wall of a shower.

3. The showerhead holder of claim 1 wherein said mounting plate is attached to the wall of a shower by suction cups.

4. The showerhead holder of claim 1 wherein said male connecting means is a male threaded attaching means.

5. The showerhead holder of claim 1 wherein said mounting coupling manufactured and supplied with said detachable showerhead can rotate 360° while said mounting coupling is attached to said mounting plate.

6. The showerhead holder of claim 1 wherein said mounting plate is mounted on a shower wall substantially below the mounting location of the original showerhead on a supply pipe.

7. The showerhead holder of claim 1 wherein said relocatable mounting plate is positioned such that the removable showerhead is aimed at a desired body part, from a mounted position adjacent to said body part.

8. A system for a shower comprising:

a. a first showerhead which is a detachable hand held showerhead, directly connected by a mounting coupling to and supported by a mounting plate connected to a shower wall;

b. a connector for a second showerhead which is in a fixed position;

c. a directional fluid valve;

d. a hose;

e. a mounting coupling including a showerhead holder for use with the detachable handheld showerhead, a mounting plate, a male connector; wherein the male connector is attached to the mounting plate and is able to receive the mounting coupling;

whereby the user may select the showerhead by changing the direction of the water supplied by moving the directional fluid valve.

9. The system of claim 8 wherein said mounting plate further comprises means for mounting said plate to the wall of a shower.

10. The system of claim 8 wherein said mounting plate is attached to the wall of a shower by suction cups.

11. The system of claim 8 wherein said male connector is a male threaded attaching means.

12. The system of claim 8 wherein said male connector can rotate 360° while attached to said mounting plate.

13. The system of claim 8 wherein said mounting plate is mounted on a shower wall substantially below the mounting location of the original showerhead on a supply pipe.

14. A kit for converting a single head fixed position showerhead into a configuration for dual head shower operation, wherein the user may select use of a fixed position showerhead or a hand held detachable showerhead, said kit comprising:

a. a t-type connector wherein said connector attaches to the existing attached plumbing fixture;

b. a showerhead holder for use with a detachable hand-held showerhead, the hand-held showerhead having a handle, the hand-held showerhead supplied with a mounting coupling having a nesting cradle configured for the size and shape of the handle for releasably holding the hand-held showerhead, and the mounting coupling having a standard female connector for connection to a standard male shower supply pipe, the holder comprising:

i. a mounting plate, said mounting plate having a male connector disposed thereon and extending outward from a planar surface of said plate, said male connector having a mounting end;

ii. said mounting end of said male connector releasably configured for receiving the female connector thereby supporting the hand-held showerhead;

c. a mounting coupling manufactured and supplied with said detachable showerhead, directly connected to and supported by said mounting plate; and d. a hose.

15. The kit of claim 14 wherein said t-type connector has one end to receive a fixed position showerhead and one end to receive a hose for a detachable hand-held showerhead.

16. The kit of claim 14 wherein said kit further comprises a cap for affixing to one opening of the t-type connector to configure the system for a single detachable hand-held showerhead.

17. The kit of claim 14 wherein said t-type connector further comprises a directional fluid valve.

18. The kit of claim 14 wherein said mounting plate is mounted on a shower wall substantially below the mounting location of the original showerhead on a supply pipe.

* * * * *